US005591237A

United States Patent [19]

Bell

[11] Patent Number: 5,591,237

[45] Date of Patent: Jan. 7, 1997

[54] FUEL ADDITIVE CONCENTRATE WITH ENHANCED STORAGE STABILITY

[75] Inventor: Donald R. Bell, Collinsville, Ill.

[73] Assignee: Ethyl Corporation, Richmond, Va.

[21] Appl. No.: 578,414

[22] Filed: Dec. 26, 1995

[51] Int. Cl.[6] ..... C10L 1/22

[52] U.S. Cl. ..... 44/325; 44/326; 44/457; 44/458

[58] Field of Search ..... 44/326, 324, 325, 44/331, 389, 457, 458

[56] References Cited

U.S. PATENT DOCUMENTS 2,616,904 11/1952 Asseff et al. ..... 260/399
4,233,035 11/1980 Allen et al. .
4,508,637 4/1985 Heintzelman et al. .
5,358,652 10/1994 Macpherson ..... 252/51.5 R

*Primary Examiner*—Margaret Medley
*Attorney, Agent, or Firm*—Dennis H. Rainear

[57] ABSTRACT

A fuel additive concentrate package comprising a detergent/dispersant, an organic nitrate combustion improver, and a corrosion inhibitor comprising dimer and/or trimer acid is provided enhanced shelf life stability by treating the concentrate with a shelf life stability amount, for example 1,500 and 10,000 ppm, respectively of acid selected from the group consisting of nitric acid/hydrochloric acid.

13 Claims, No Drawings

FUEL ADDITIVE CONCENTRATE WITH ENHANCED STORAGE STABILITY

BACKGROUND OF THE INVENTION

This invention relates to a method and composition for hydrocarbonaceous fluid additive concentrates which provide enhanced shelf-life stability, including a reduced tendency to develop a hazy appearance and to form sludge.

Detergent/dispersant compositions are typically an important component of many hydrocarbonaceous fluid additive packages, or concentrates, and are used commercially to reduce the amount of deposits in automotive and diesel engines and engine components. Combustion improvers such as organic nitrate esters are also an important component of the additive package. Corrosion inhibitors such as dimer and trimer acids produced from tall oil fatty acids, oleic acid, linoleic acid, or the like, are commonly incorporated into fuel additive packages. By hydrocarbonaceous fluids is meant any one or more of fuels, including gasoline, diesel, jet fuel, marine fuels, and the like; or lubricants, either natural or synthetic. Detergent/dispersant compositions may be added to such hydrocarbonaceous fluids separately, however, they are generally added as part of an additive package, which package may contain other components such as demulsifiers, corrosion inhibitors, cold starting aids, dyes, metal deactivators, octane improvers, cetane improvers, emission control additives, antioxidants, and the like.

Typically, fuel additive packages containing combustion improver and detergent/dispersant compositions are prepared as concentrates in bulk and are added to fuels in amounts ranging from about 25 to about 500 pounds per thousand barrels of fuel or more. These bulk concentrates, however, do not always remain clear. Components of the additive concentrates tend to separate from the package, or there may be some interaction among the various components under storage conditions which give the package a hazy appearance or create undesirable sludge in the bulk concentrate during storage. In order to assure uniform addition of all components of the package to hydrocarbonaceous fluids, it is desirable that the components remain in a substantially homogeneous solution. Thus it is an object of this invention to provide a stable hydrocarbonaceous fluid additive package. It is another object of this invention to provide a means for stabilizing a hydrocarbonaceous fluid additive package for long term storage, particularly to reduce the formation of hazy appearance, sludge or sediment in the fuel additive package on long term storage.

SUMMARY OF THE INVENTION

In a fuel additive concentrate package comprising a detergent/dispersant, an organic nitrate combustion improver, and a corrosion inhibitor comprising dimer and/or trimer acid, enhanced shelf life stability for the concentrate is obtained by incorporating into the concentrate a minor amount of acid selected from the group consisting of nitric acid, hydrochloric acid, and lower molecular weight aliphatic monocarboxylic acid or acid-producing compounds.

DESCRIPTION OF THE PREFERRED EMBODIMENT

The hydrocarbonaceous fluid additive package of the invention, preferably a fuel additive concentrate, is characterized by having enhanced shelf-life stability. Fuel additive packages of this invention comprise a detergent/dispersant composition, an organic nitrate ester combustion improver, or cetane improver, and a dimer and/or trimer acid corrosion inhibitor which have been treated in accordance with the invention herein. It has been discovered that there is a stabilizing interaction between the additive package and the acid treatment described herein.

This discovery has thus provided a formulation and means for enhancing the stability of hydrocarbonaceous fluid additive packages, preferably fuel additive packages, so that the packages remain clear and in substantially homogeneous solution even when stored for long periods of time. Such a homogeneous clear solution assures that substantially all of the components of the additive package are added to the fuel. In contrast, if one or more components of the additive package separate from the solution, as evidenced by a hazy appearance of the additive package, there is no assurance that the component(s) will be added to the fuel in the desired amount. With use of the methods and compositions of this invention, storage stable additive packages are obtained.

A critical feature of this invention is the incorporation of a minimal amount of acid selected from the group consisting of nitric acid, hydrochloric acid, and lower molecular weight aliphatic monocarboxylic acid or acid-producing compounds in combination with a hydrocarbonaceous fluid additive package such as a fuel additive package. The acid is added to the bulk concentrate in an amount effective to provide enhanced stability to the additive package during storage, which is evidenced by reduced tendency for the additive package to develop a hazy appearance or for formation of undesired sludge. For example, an amount of from 500 to 10,000 parts per million (ppm) acid, based on the weight of the fuel additive package, can effectively be added to treat the fuel additive package to reduce or eliminate the appearance of haze. This acid can be effectively added at the time the components are blended to form the additive concentrate, thus serving to prevent the creation of sludge and haze during storage, or can be added at a later time, for example after a hazy appearance develops during storage in order to clear the haze and restore the concentrate to a substantially homogeneous solution. To form the compositions of this invention, standard commercially available mixing equipment may be used and the components combined and mixed in a conventional manner.

Detergent/Dispersants

Detergent/dispersants useful in forming the additive packages of this invention comprise the reaction product of (i) polyamine and (ii) at least one acyclic hydrocarbyl-substituted succinic acylating agent. The polyamine reactant may be one or more alkylene polyamine(s), which polyamines may be linear, branched, or cyclic; or a mixture of linear, branched and/or cyclic polyamines and wherein each alkylene group contains from about 1 to about 10 carbon atoms. A preferred polyamine is a polyamine containing from 2 to 10 nitrogen atoms per molecule or a mixture of polyamines containing an average of from about 2 to about 10 nitrogen atoms per molecule. A particularly preferred polyamine is a polyamine or mixture of polyamines having from about 3 to 7 nitrogen atoms with tetraethylene pentamine or a combination of ethylene polyamines which approximate tetraethylene pentamine being the most preferred. In selecting an appropriate polyamine, consideration should be given to the compatibility of the resulting detergent/dispersant with the fuel mixture with which it is mixed.

Ordinarily, a preferred polyamine, tetraethylene pentamine, will comprise a commercially available mixture having the general overall composition approximating that of tetraethylene pentamine but which can contain minor amounts of branched-chain and cyclic species as well as some linear polyethylene polyamines such as diethylene triamine and triethylene tetramine.

The acylating agent which is reacted with the polyamine is an acyclic hydrocarbyl-substituted succinic acylating agent in which the substituent contains an average of 50 to 100 (preferably 64 to 80) carbon atoms. It is desirable that the acyclic hydrocarbyl substituted succinic acylating agent have an acid number in the range of 0.7 to 1.1 (preferably in the range of 0.8 to 1.0, and most preferably 0.9).

When preparing the detergent/dispersants of this invention, the molar ratio of acylating agent to polyamine in the reaction product of (i) and (ii) is desirably greater than 1:1. Preferably the molar ratio of acylating agent to polyamine in the reaction product is in the range of about 1.5:1 to about 2.2:1, more preferably from about 1.7:1 to about 1.9:1, and most preferably about 1.8:1.

The acid number of the acyclic hydrocarbyl substituted succinic acylating agent is determined in the customary way-i.e., by titration-and is reported in terms of mg of KOH per gram of product. It is to be noted that this determination is made on the overall acylating agent with any unreacted olefin polymer (e.g., polyisobutene) present.

The acyclic hydrocarbyl substituent of the acylating agent is preferably an alkyl or alkenyl group having the requisite number of carbon atoms as specified above. Alkenyl substituents derived from poly- alpha -olefin homopolymers or copolymers of appropriate molecular weight (e.g., propene homopolymers, butene homopolymers, C3 and C4 alpha -olefin copolymers, and the like) are suitable. Most preferably, the substituent is a polyisobutenyl group formed from polyisobutene having a number average molecular weight (as determined by gel permeation chromatography) in the range of 700 to 1200, preferably 900 to 1100, most preferably 940 to 1000.

Acyclic hydrocarbyl-substituted succinic acid or anhydride acylating agents and methods for their preparation and use in the formation of succinimide are well known to those skilled in the art and are extensively reported in the patent literature. See for example the following U.S. Pat. Nos. 3,018,247; 3,018,250; 3,578,422; 3,658,494; 3,658,495; 3,912,764; 4,110,349 and 4,234,435, among others.

When utilizing the general procedures such as described in these and other patents, the important considerations insofar as the present invention is concerned, are to insure that the hydrocarbyl substituent of the acylating agent contain the requisite number of carbon atoms, that the acylating agent have the requisite acid number, that the acylating agent be reacted with the requisite polyethylene polyamine, and that the reactants be employed in proportions such that the resultant succinimide contains the requisite proportions of the chemically combined reactants, all as specified herein. When utilizing this combination of features, detergent/dispersants are formed which possess exceptional effectiveness in controlling or reducing the amount of deposits and exhaust emissions formed during engine operation.

The acyclic hydrocarbyl-substituted succinic acylating agents include the hydrocarbyl-substituted succinic acids, the hydrocarbyl-substituted succinic anhydrides, the hydrocarbyl-substituted succinic acid halides (especially the acid fluorides and acid chlorides), and the esters of the hydrocarbyl-substituted succinic acids and lower alcohols (e.g., those containing up to 7 carbon atoms), that is, hydrocarbyl-substituted compounds which can function as carboxylic acylating agents. Of these compounds, the hydrocarbyl-substituted succinic acids and the hydrocarbyl-substituted succinic anhydrides and mixtures of such acids and anhydrides are generally preferred, the hydrocarbyl-substituted succinic anhydrides being particularly preferred.

The acylating agent used in producing the detergent/dispersants useful in this invention is preferably made by reacting a polyolefin of appropriate molecular weight (with or without chlorine) with maleic anhydride. However, similar carboxylic reactants can be employed such as maleic acid, fumaric acid, malic acid, tartaric acid, itaconic acid, itaconic anhydride, citraconic acid, citraconic anhydride, mesaconic acid, ethylmaleic anhydride, dimethylmaleic anhydride, ethylmaleic acid, dimethylmaleic acid, hexylmaleic acid, and the like, including the corresponding acid halides and lower aliphatic esters.

The reaction between (i) polyamine and (ii) at least one acyclic hydrocarbyl-substituted succinic acylating agent is generally conducted at temperatures of 80° C. to 200° C., more preferably 140° C. to 180° C., such that a succinimide is formed. These reactions may be conducted in the presence or absence of an ancillary diluent or liquid reaction medium, such as a mineral lubricating oil solvent. Suitable solvent oils include natural and synthetic base oils. The natural oils are typically mineral oils. Suitable synthetic diluents include polyesters, hydrogenated or unhydrogenated poly- alpha -olefins (PAO) such as hydrogenated or unhydrogenated 1-decene oligomer, and the like. Blends of mineral oil and synthetic oils are also suitable for this purpose. In a particularly preferred embodiment, the reactions are conducted in the presence of a mineral oil such as 100 solvent neutral. As used herein, the term succinimide is meant to encompass the completed reaction product from components (i) and (ii) and is intended to encompass compounds wherein the product may have amide, amidine, and/or salt linkages in addition to the imide linkage of the type that results from the reaction of a primary amino group and an anhydride moiety.

Corrosion Inhibitors

Materials useful as corrosion inhibitors in the practice of this invention include dimer and/or trimer acids, such as are produced from tall oil fatty acids, oleic acid, linoleic acid, or the like. Products of this type are currently available from various commercial sources, such as, for example, the dimer and trimer acids sold under the HYSTRENE trademark by the Humko Chemical Division of Witco Chemical Corporation and under the EMPOL trademark by Emery Chemicals.

Acid Component

The acid component is selected from the group consisting of nitric acid, hydrochloric acid, and certain carboxylic acids. The carboxylic acids useful in the invention are aliphatic monocarboxylic acid or acid-producing compounds. These carboxylic acids include lower molecular weight carboxylic acids (e.g., carboxylic acids having up to about 30 carbon atoms such as acids having about 2 to about 22 carbon atoms). Throughout this specification and in the appended claims, any reference to carboxylic acids is intended to include the acid-producing derivatives thereof such as anhydrides, lower alkyl esters, acyl halides, lactones and mixtures thereof unless otherwise specifically stated.

The lower molecular weight monocarboxylic acids contemplated for use in this invention include saturated and unsaturated acids. Examples of such useful acids include acetic acid, octanoic acid, 2-ethylhexanoic acid, dodecanoic acid, decanoic acid, oleic acid, stearic acid, linoleic acid, tall oil acid, etc. Mixtures of two or more such agents can also be used.

The monocarboxylic acids include isoaliphatic acids. Such acids often contain a principal chain having from about 14 to about 20 saturated, aliphatic carbon atoms and at least one but usually no more than about four pendant acyclic lower alkyl groups. Specific examples of such isoaliphatic acids include 10-methyltetradecanoic acid, 3-ethyl-hexadecanoic acid, and 8-methyl-octadecanoic acid. The isoaliphatic acids include mixtures of branch-chain acids prepared by the isomerization of commercial fatty acids (oleic, linoleic or tall oil acids) of, for example, about 16 to about 20 carbon atoms.

Organic Nitrate Combustion Improvers

The organic nitrate combustion improvers (also frequently known as ignition improvers) comprise nitrate esters of substituted or unsubstituted aliphatic or cycloaliphatic alcohols which may be monohydric or polyhydric. Preferred organic nitrates are substituted or unsubstituted alkyl or cycloalkyl nitrates having up to about 10 carbon atoms, preferably from 2 to 10 carbon atoms. The alkyl group may be either linear or branched (or a mixture of linear and branched alkyl groups). Specific examples of nitrate compounds suitable for use in the present invention include, but are not limited to, the following: methyl nitrate, ethyl nitrate, n-propyl nitrate, isopropyl nitrate, allyl nitrate, n-butyl nitrate, isobutyl nitrate, sec-butyl nitrate, tert-butyl nitrate, n-amyl nitrate, isoamyl nitrate, 2-amyl nitrate, 3-amyl nitrate, tert-amyl nitrate, n-hexyl nitrate, n-heptyl nitrate, sec-heptyl nitrate, n-octyl nitrate, 2-ethylhexyl nitrate, sec-octyl nitrate, n-nonyl nitrate, n-decyl nitrate, cyclopentyl nitrate, cyclohexyl nitrate, methylcyclohexyl nitrate, isopropylcyclohexyl nitrate, and the like. Also suitable are the nitrate esters of alkoxy substituted aliphatic alcohols such as 2-ethoxyethyl nitrate, 2-(2-ethoxy-ethoxy)ethyl nitrate, 1-methoxypropyl-2-nitrate, 4-ethoxybutyl nitrate, etc., as well as diol nitrates such as 1,6-hexamethylene dinitrate, and the like. While not particularly preferred, the nitrate esters of higher alcohol may also be useful. Such higher alcohols tend to contain more than 10 carbon atoms. Preferred are the alkyl nitrates having from 5 to 10 carbon atoms, most especially primary amyl nitrates, primary hexyl nitrates, and octyl nitrates such as 2-ethylhexyl nitrate, and mixtures thereof. The use and methods of prepartion of these organic nitrate combustion improvers are known in the art.

Other components may be used in the additive package including oxidation inhibitors or antioxidants, corrosion inhibitors, emission control additives, lubricity additives, demulsifiers, antifoams, biocides, dyes, octane or cetane improvers, and the like.

The practice of this invention is illustrated by the following non-limiting example.

EXAMPLE

A commercially available bulk concentrate fuel additive package (HiTEC© 4226 diesel fuel additive package from Ethyl Corporation) had developed a hazy appearance under storage conditions which indicated that the concentrate had lost dersirable characteristics of a homogeneous solution. Treatment with a minimal amount of nitric acid (1500 ppm $HNO_3$ was added to a sample of the hazy concentrate) rendered the concentrate clear and stable. The acid treatment was repeated with additional acids set forth in Table 1 below. In these examples the acid was added incrementally until the solution became clear, with the amount required to obtain the clear solution reported as acid charge. The results show that only specific acids provided the desired treatment to obtain a clear package. Various acids, including the relatively weak acetic acid, were shown to be effective to render the hazy package clear, while the strong sulfuricacid and oleum were not effective.

TABLE I

Acid Treatment of Hazy Concentrate

| Acid | Acid Charge, ppm | Concentrate Appearance After Treatment |
|---|---|---|
| Nitric (98+%) | 1500 | Clear |
| Acetic (97%) | 3200 | Clear |
| Octanoic | 4000 | Clear |
| Oleic | 6000 | Clear |
| 2-Ethylhexanoic | 4000 | Clear |
| Hydrochloric | 10,000 | Clear |
| Sulfuric | 4000 | Hazy, Very Dark |
| Oleum | 1000 | Hazy, Very Dark |
| Phosphorous | 20,000 | Hazy |
| Phosphoric | 20,000 | Hazy |
| Dimer | 20,000 | Hazy |

Variations of the invention are within the spirit and scope of the ensuing claims.

What is claimed is:

1. In a fuel additive concentrate package comprising a detergent/dispersant, an organic nitrate combustion improver, and a corrosion inhibitor comprising dimer and/or trimer acid, the improvement wherein said concentrate additionally comprises a shelf life stability amount of acid selected from the group consisting of nitric acid and hydrochloric acid, said shelf life stability amount of acid being sufficient to provide enhanced shelf life stability to said concentrate.

2. A concentrate according to claim 1 wherein the detergent/dispersant is a reaction product of (i) an alkyl or alkenyl substituted succinic acid or anhydride and (ii) an alkylenepolyamine or mixture of alkylenepolyamines wherein the alkyl or alkenyl group of the substituted succinic acid or anhydride contains from about 10 to about 1000 carbon atoms and wherein the organic nitrate combustion improver comprises a nitrate ester of a substituted or unsubstituted aliphatic or cycloaliphatic alcohol.

3. A concentrate according to claim 2 wherein said acid is nitric acid.

4. A concentrate according to claim 3 wherein said acid is about 1,500 parts per million based on weight of the concentrate.

5. A concentrate according to claim 2 wherein the organic nitrate combustion improver comprises an alkyl nitrate having from 5 to 10 carbon atoms selected from the group consisting of primary amyl nitrates, primary hexyl nitrates, and octyl nitrates and mixtures thereof.

6. A concentrate according to claim 5 wherein the organic nitrate combustion improver is 2-ethylhexyl nitrate.

7. A concentrate according to claim 5 said acid is nitric acid in an amount of about 1,500 parts per million based on weight of the concentrate.

8. A concentrate according to claim 2 wherein the detergent/dispersant comprises the reaction product of (i) an alkyl or alkenyl substituted succinic acid or anhydride wherein the alkyl or alkenyl group has a number average molecular weight in the range of from about 750 to about 2300 and (ii) an alkylenepolyamine or mixture of alkylenepolyamines approximating tetraethylene pentamine and wherein the organic nitrate combustion improver comprises a nitrate ester of at least one primary alkanol having up to 10 carbon atoms in the molecule.

9. A concentrate according to claim 8 wherein the organic nitrate combustion improver comprises an alkyl nitrate having from 5 to 10 carbon atoms selected from the group consisting of primary amyl nitrates, primary hexyl nitrates, and octyl nitrates and mixtures thereof.

10. A concentrate according to claim 9 wherein said acid is nitric acid.

11. A concentrate according to claim 10 wherein said shelf life stability amount of acid is about 1,500 parts per million based on weight of the concentrate.

12. A method for enhancing the shelf-life stability of a fuel additive concentrate package which comprises a detergent/dispersant, an organic nitrate combustion improver, and a corrosion inhibitor comprising dimer and/or trimer acid, the method comprising admixing a shelf life stability amount of acid selected from the group consisting of nitric acid and hydrochloric acid, with said concentrate, said shelf life stability amount of acid being sufficient to provide enhanced shelf life stability to said concentrate.

13. The method of claim 12 wherein the detergent/dispersant is a reaction product of (i) an alkyl or alkenyl substituted succinic acid or anhydride and (ii) a alkylenepolyamine or mixture of alkylenepolyamines wherein the alkyl or alkenyl group of the substituted succinic acid or anhydride contains from about 10 to about 1000 carbon atoms and wherein the organic nitrate combustion improver comprises a nitrate ester of a substituted or unsubstituted aliphatic or cycloaliphatic alcohol.

* * * * *